US006286257B1

(12) United States Patent
Gregoriou et al.

(10) Patent No.: US 6,286,257 B1
(45) Date of Patent: Sep. 11, 2001

(54) OVERHEAD DOOR WITH DUAL SAFETY-EDGE

(75) Inventors: Daniel J. Gregoriou, Kewaskum; Jeffrey Konetzki, Menomonee Falls, both of WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 09/507,834

(22) Filed: Feb. 22, 2000

Related U.S. Application Data

(60) Provisional application No. 60/121,044, filed on Feb. 22, 1999.

(51) Int. Cl.[7] ..... E05F 15/02
(52) U.S. Cl. ..... 49/27
(58) Field of Search ..... 49/26, 27, 28; 200/61.43

(56) References Cited

U.S. PATENT DOCUMENTS

| | | | | |
|---|---|---|---|---|
| 3,303,303 | * | 2/1967 | Miller | 49/27 X |
| 3,315,050 | | 4/1967 | Miller . | |
| 3,462,885 | | 8/1969 | Miller . | |
| 4,143,367 | | 3/1979 | Schestag . | |
| 4,273,974 | | 6/1981 | Miller . | |
| 4,501,963 | | 2/1985 | Perisic . | |
| 4,676,293 | | 6/1987 | Hanssen . | |
| 4,924,214 | | 5/1990 | Hill . | |
| 4,944,116 | | 7/1990 | Mewald . | |
| 4,953,608 | | 9/1990 | Larsson . | |
| 5,027,552 | * | 7/1991 | Miller et al. | 49/27 |
| 5,057,819 | | 10/1991 | Valenti . | |
| 5,141,044 | | 8/1992 | Hying et al. . | |
| 5,157,230 | | 10/1992 | Blubaugh . | |
| 5,198,974 | | 3/1993 | Orsat . | |
| 5,239,146 | | 8/1993 | Blubaugh . | |
| 5,299,617 | | 4/1994 | Hying et al. . | |
| 5,384,982 | | 1/1995 | Galperin . | |
| 5,438,798 | * | 8/1995 | Plamper et al. | 49/28 |
| 5,566,504 | * | 10/1996 | Pitel | 49/27 X |
| 5,629,681 | | 5/1997 | DuVall et al. . | |
| 5,912,625 | * | 6/1999 | Scofield | 49/27 X |
| 5,921,026 | * | 7/1999 | Miller | 49/27 |

OTHER PUBLICATIONS

Attached copy of photograph of a prior hanger used in connection with overhead doors which were publicly available at least as early as Nov. 1996.

* cited by examiner

*Primary Examiner*—Jerry Redman
(74) *Attorney, Agent, or Firm*—Wallenstein & Wagner, Ltd.

(57) ABSTRACT

A door assembly comprising a door body having a bottom edge. The door body is selectively movable up and down to open and close an opening. The door assembly further comprises a first sensor body and a second sensor body. Each sensor body is in communication with a door controller, and each sensor body has an impact portion responsive to an impact proximate the bottom edge of the door body.

14 Claims, 4 Drawing Sheets

OVERHEAD DOOR WITH DUAL SAFETY-EDGE

CROSS-REFERENCE TO RELATED APPLICATION

This application claims the benefit of U.S. Provisional Application No. 60/121,044 filed Feb. 22, 1999.

TECHNICAL FIELD

The invention relates to industrial doors, in particular overhead industrial doors with closure safety mechanisms.

BACKGROUND OF THE INVENTION

Overhead doors have been used for many years to secure various enclosures including manufacturing plants, warehouses, garages, and other industrial doorways. It is well known in the art to provide a safety device on the leading edge of these doors to minimize both damage to the doors and potential injury to users when the door is closing. Such safety devices are generally coupled to a door controller. If the safety device encounters an impact, a signal is transmitted to the controller. The signal causes the door to act in a prescribed manner. For example, the controller may cause the door to stop or reverse direction.

Typically, safety edges of the type found in U.S. Pat. No. 3,462,885 to Miller are employed. In particular, the safety edge in Miller is comprised of a resiliently compressible structure. The resilient structure includes a pair of flexible contact strips which are electrically connected to a motor. Upon deflection of the resilient structure, the contact strips engage one another and transmit an electrical signal to the motor, resulting in stoppage or reversal of the door. Alternatively, pneumatically actuated safety edges may be employed. Pneumatically actuated safety edges consist of fluid-filled chambers which are coupled to pressure sensors. The pressure sensors are responsive to pulses or changes in fluid pressure within a chamber. While both of these safety edges assist in preventing damage to the door and provide some degree of safety to the users, there exist inherent limitations in both systems.

Specifically, safety edges such as those found in Miller are less sensitive to impact applied perpendicular to the door body than pneumatically actuated safety edges. Furthermore, safety edges such as those in Miller tend to allow for only minimal door over-travel.

Conversely, pneumatically actuated safety edges tend to be more sensitive to impacts in multiple directions. Pneumatically actuated safety edges, however, are more susceptible to rupture than the safety edges in Miller. For instance, a pneumatically actuated safety edge may receive a puncture or rupture in its fluid-filled chamber. Thus, changes in pressure may not be sensed by the system.

While both of the safety edges discussed above have been met with a reasonable degree of success, the present invention is provided to solve the problems discussed above and other problems, and to provide advantages and aspects not provided by prior doors of this type.

SUMMARY OF THE INVENTION

The present invention provides a door assembly comprising a door body having a bottom edge. The door body is selectively movable up and down to open and close an opening. The door assembly further comprises a first sensor body and a second sensor body. Each sensor body is in communication with a door controller, and each sensor body has an impact portion responsive to an impact.

According to one aspect of the present invention, a door assembly is provided in which one of the sensor bodies has a greater sensitivity to impact perpendicular to the sensor body. Likewise, the other of the sensor bodies has a greater sensitivity to impact parallel to the sensor body than the first sensor body.

According to another aspect of the present invention, the location of the first sensor body with respect to the second sensor body results in one of the sensor bodies having a greater sensitivity than the other sensor body.

According to still another aspect of the present invention, the difference in the type of the first sensor body with respect to the type of the second sensor body results in one of the sensor bodies having a greater sensitivity than the other sensor body.

According to yet another aspect of the present invention, the first sensor body and a second sensor bodies are mechanically coupled, one to the other, by a hanger. The hanger extends from the bottom edge of the door body. One of the sensor bodies is disposed proximate a first end of the hanger and the bottom edge of the door body, and the other sensor body is attached proximate a distal second end of the hanger.

According to yet another aspect of the present invention, the hanger provides a contact area along the first sensor body greater than the contact area along the second sensor body, thereby allowing for an improved transfer of the force from of the second sensor body to the first sensor body.

Other advantages and aspects of the present invention will become apparent upon reading the following description of the drawings and detailed description of the invention.

DETAILED DESCRIPTION

Figure 2:
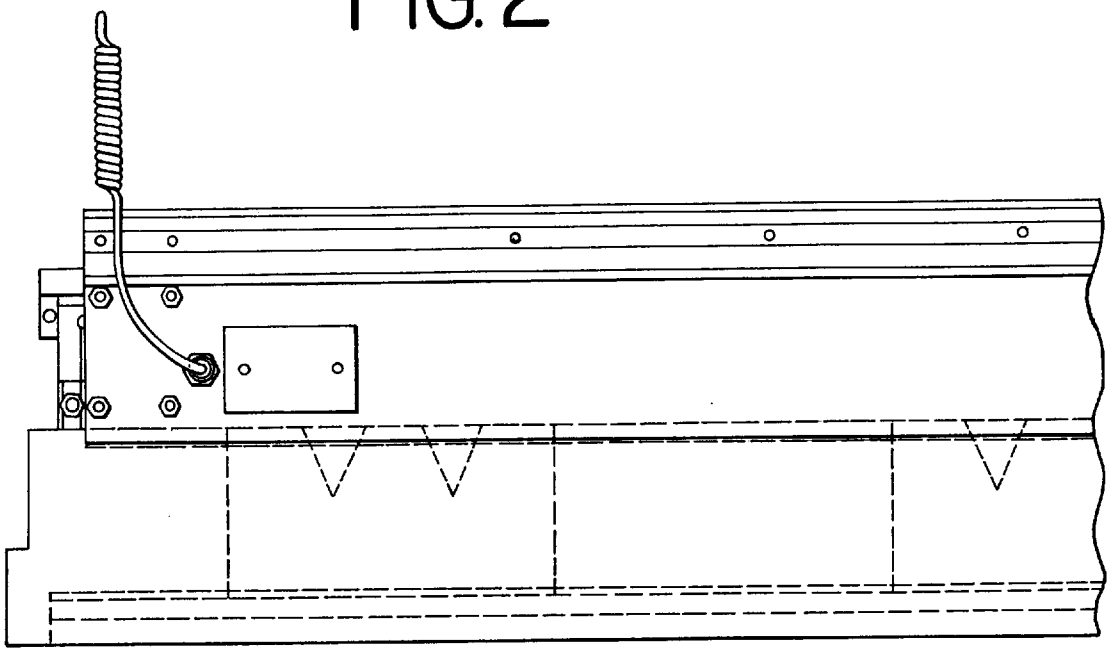
FIG. 2 is a partial front view of the dual safety edge according to the present invention.
Figure 1:
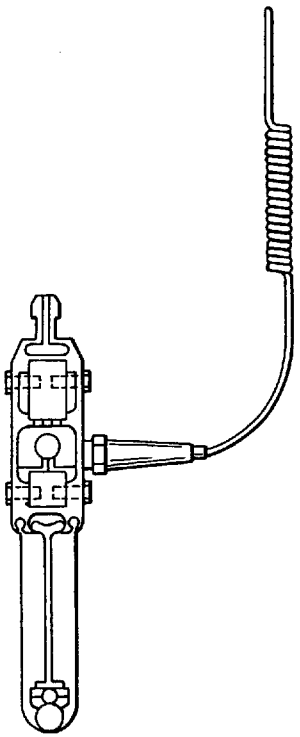
FIG. 1 is a side view of the dual safety edge according to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1–10 disclose an improvement on previous overhead door assemblies that employ a safety device on its leading edge. In particular, the present invention combines both conventional and non-conventional sensor bodies to provide an improved overhead door with a redundant back-up safety edge system.

Specifically, FIGS. 1–10 disclose a door assembly 1 comprising a door body 10 having a bottom edge 12. The door body 10 may be selectively moved up and down to open and close an opening 14. The door assembly 1 further comprises a first sensor body 16 and a second sensor body 18. Each of the sensor bodies 16,18 has an impact portion 19 responsive to an impact. Each of the sensor bodies 16,18 is in communication with a door controller (not shown).

Generally, one of the sensor bodies 16,18 has a greater sensitivity to an impact perpendicular to the sensor body 16,18, than the other of the sensor bodies 16,18. Likewise, the other of the sensors bodies 16,18 has a greater sensitivity to an impact parallel to the sensor body 16,18 than the sensor body 16,18 that is more sensitive to perpendicular impact. The disparity in sensitivity may be a result of the location of the first sensor body 14 with respect to the second sensor body 18. Alternatively, the distinction in sensitivity may be a result of the difference in the type of the first sensor body 16 as compared to the type of the second sensor body 18.

Each of the sensor bodies 16,18 is in independent communication with the door controller. Accordingly, each of the sensor bodies 16,18 works autonomously, and each generates a separate signal which is transmitted to the controller upon impact of a predetermined force to either sensor body 16,18. Because the sensor bodies 16,18 generate separate signals, each sensor body 16,18 operates as a redundant back-up to the other sensor body 16,18. It is contemplated, however, that only one of the sensor bodies 16,18 generate a signal upon an impact in excess of a predetermined force.

Figure 3:
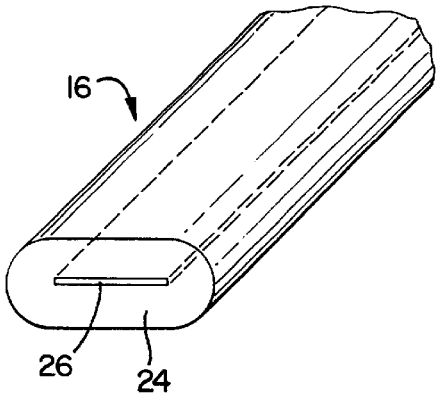
FIG. 3 is a partial perspective view of one embodiment of a sensor body with a deflectable element.

In the preferred embodiment, the first sensor body 16 includes a first mechanical actuator and the second sensor body 18 includes a second and structurally distinguishable mechanical actuator. FIG. 3 illustrates one type of actuator that may be employed in the sensor bodies 16,18. The actuator shown in FIG. 3 includes a sensing circuit 24 having at least one mechanically deflectable element 26. The deflectable element 26 is positioned within at least a portion of the sensor body 16,18 such that an impact to the sensor body 16,18 in excess of a predetermined force will deflect the deflectable element 26. The deflection of the deflectable element 26 changes the electrical state of the sensing circuit 24. A signal indicative of the change in the sensing circuit 24 is generated. Such signal is subsequently communicated to the controller, thereby causing the door body 10 to respond in a predetermined manner. The signal may be transmitted to the controller directly, or the signal may be conditioned or converted by some appropriate intermediate means.

It is contemplated that the change in the sensing circuit 24 be created by one of various types of electrical phenomenon. For example, the deflectable element 26 may be a piezoelectric element, wherein the deflection of the piezoelectric element results in a change in voltage in the circuit 24. Alternatively, the deflectable element 26 may be made from a material which, upon deflection, results in a change in the inductance of the circuit 24.

Figure 5:
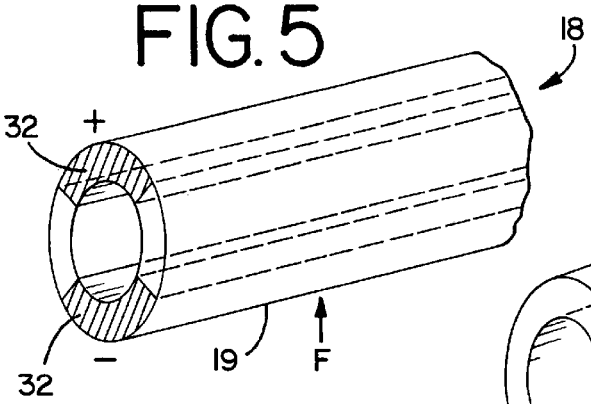
FIG. 5 is a partial perspective view of another embodiment of a sensor body wherein the deflectable element is a conductive polymer that defines at least a portion of the sensor body.

As shown in FIG. 5, the deflectable element 26 may also be a conductive polymer 32 that defines at least a portion of the impact portion 19 of the sensor body 16,18. When the sensor body 16,18 is impacted by a force in excess of a predetermined amount, the conductive polymer 32 deflects in such a manner that the electrical state of the polymer 32 is changed. The conductive polymer 32 may be of the type generally marketed by Matamatic, Inc and described in U.S. Pat. No. 5,060,527. Again, the change in electrical state of the polymer 32 generates a signal indicative of the change which, in turn, is transmitted to the controller.

Figure 4:
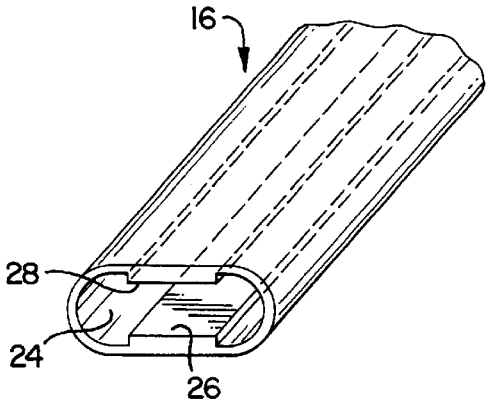
FIG. 4 is a partial perspective view of one embodiment of a sensor body with a first and a second deflectable element.

As shown in FIG. 4, the sensing circuit 24 may also include a second deflectable element 28 disposed adjacent the first deflectable element 26, wherein either the first or second deflectable elements 26,28 is coupled to a power source (not shown). The first and second deflectable elements 26,28 are oriented such that when the impact portion 19 of the sensor body 16,18 receives an impact in excess of a predetermined force, either the first or second deflectable elements 26,28 is deflected toward the other deflectable element 26,28 in such a manner as to change the electrical state of the circuit 24. In this configuration, the sensing circuit 24 is normally an open circuit. Deflection of the deflectable elements 26,28, one toward the other, results in conductively closing the circuit 24. Closure of the circuit 24 causes a signal to be generated, which is in turn transmitted in some form to the controller.

Figure 6:
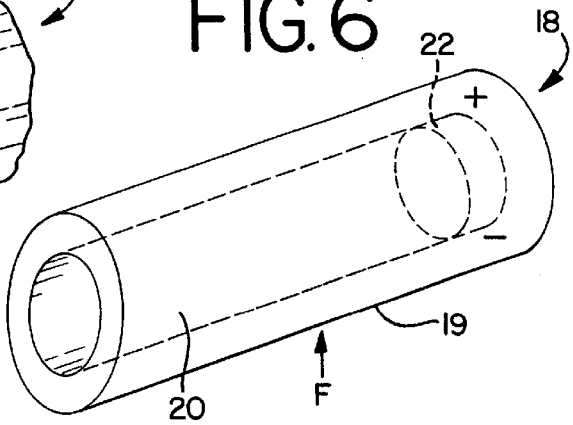
FIG. 6 is a partial perspective view of one embodiment of a pneumatically actuated sensor body.
Figure 7:
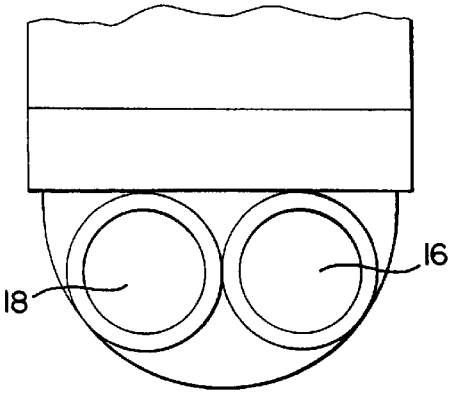
FIG. 7 is a side view of one dual safety edge configuration according to the present invention.

FIG. 6 illustrates another type of actuator that may be employed in the sensor bodies 16,18. Particularly, FIG. 5 shows an actuator comprised of a fluid-filled tube 20 pneumatically coupled to a fluid pressure sensor 22. The pressure sensor 22 is responsive to changes in the pressure of the fluid in the tube 20. Specifically, upon sensing a change in pressure, the pressure sensor 22 generates a signal indicative of the change. The signal is subsequently communicated, in some form, to the controller at which point the controller causes the door body 10 to respond in a predetermined manner. In the preferred embodiment, the tube 20 contains air which has been charged at atmospheric pressure. However, the tube 20 may be filled with any fluid suitable to provide a change in pressure upon receiving an impact in excess of a predetermined force.

Figure 8:
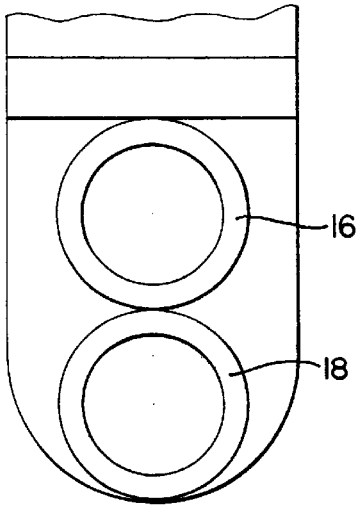
FIG. 8 is a side view of another dual safety edge configuration according to the present invention.
Figure 9:
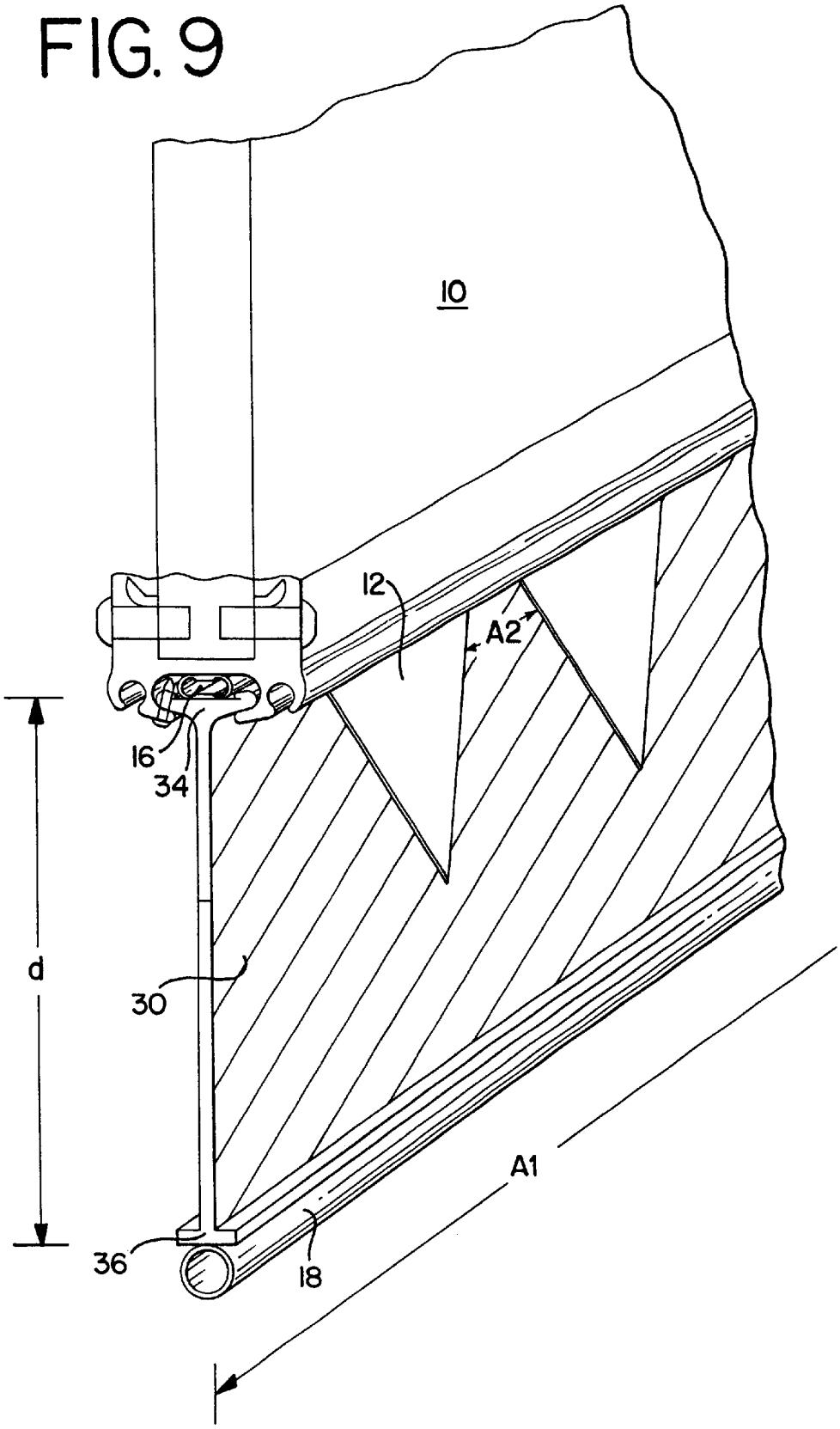
FIG. 9 is a partial perspective view of one embodiment of the dual safety edge wherein the sensor bodies are mechanically coupled by a hanger according to the present invention; and, FIG. 10 is a partial perspective view of another embodiment of the dual safety edge wherein the sensor bodies are mechanically coupled by a hanger according to the present invention.
Figure 10:
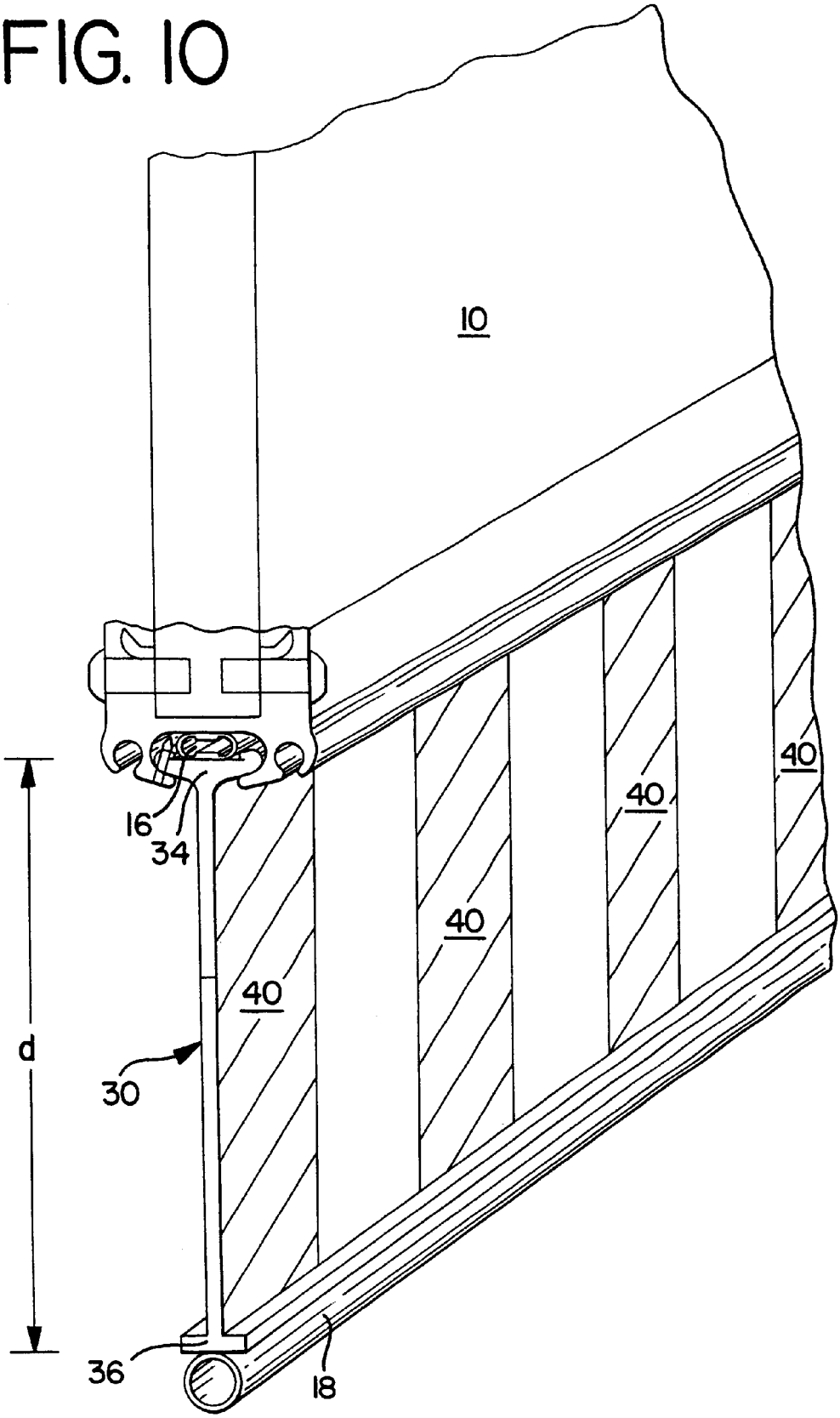

As may be seen in FIGS. 7–10, the sensor bodies 16, 18 may located in various positions relative to one another. However, as illustrated in FIGS. 9 and 10, the preferred embodiment provides that the first and second sensor bodies 16,18 be mechanically coupled by a hanger 30. The hanger 30 has a first end 34 attached to the bottom edge 12 of the door body 10. The second sensor body 18 is disposed proximate the first end 34 of the hanger 30 and the bottom edge 12 of the door body 10. Likewise, the first sensor body 16 is attached proximate a distal second end 36 of the hanger 30. Thus, some distance d is provided between the first and second sensor bodies 16,18. It is contemplated that the distance d be any distance. The hanger 30, however, allows for at least some force from an impact to the first sensor body 16 to be transferred across the distance d to the second sensor body 18, while simultaneously allowing for some over-travel of the door body 10.

In the preferred embodiment, the hanger includes a means for reducing the damping of the force that is transferred from the second sensor body 18 to the first sensor body 16 due to the intermediate hanger 30. FIG. 9 illustrates one such means. As shown in FIG. 8, the hanger 30 provides a contact area A1 on the hanger 30 and proximate the second sensor body 18 greater than the contact area A2 on the hanger 30 and proximate the first sensor body 16. The lesser contact area A2 is created by providing a plurality of openings 38 along the length of the hanger 30, and proximate the second sensor body 18. The configuration, however, may be any that amplifies the force per unit area applied to the first sensor body 16. For example, as shown in FIG. 10, the hanger 30 may be comprised of a plurality of spaced apart sections 40 in which each section 40 provides a contact point for concentrating the transferred force received by the first sensor body 16.

While the specific embodiments have been illustrated and described, numerous modifications come to mind without significantly departing from the spirit of the invention and the scope of protection is only limited by the scope of the accompanying claims.

We claim:

1. A door assembly comprising:

a door body having a bottom edge, the door body being selectively movable up and down to open and close an opening; and, a first sensor body and a second sensor body each having an impact portion responsive to an impact proximate the bottom edge of the door body, the first and second sensor bodies being mechanically coupled one to the other by a hanger, the hanger extending from the bottom edge of the door body, the first sensor body being disposed between a first end of the hanger and the bottom edge of the door body and the second sensor body being attached proximate a distal second end of the hanger, and both the first and second sensor in communication with a controller, thereby causing a predetermined response in the door body when one of the first and second sensor bodies receives an impact of at least a predetermined force.

2. The door assembly of claim 1 further including a means for reducing damping of the force transferred across the hanger from the second sensor body to the first sensor body.

3. The door assembly of claim 2 wherein a plurality of openings along the hanger and proximate the second sensor body result in the contact area along the hanger and proximate the second sensor body being greater than the contact area along the first sensor body.

4. The door assembly of claim 1 wherein the means for reducing damping includes providing a contact area on the hanger and proximate the second sensor body greater than the contact area on the hanger proximate the first sensor body, thereby amplifying the force per unit area applied to the first sensor body.

5. The door assembly of claim 1 wherein one of the first sensor body and the second sensor body has a greater sensitivity to impact perpendicular to the sensor body than the other of the first and second sensor bodies and the other of the first and second sensors bodies has a greater sensitivity to impact parallel to the sensor body than the other of the first and second sensor bodies.

6. The door assembly of claim 1 wherein the first sensor body includes a first mechanical actuator and the second sensor body includes a second mechanical actuator, the second mechanical actuator being structurally distinguishable from the first actuator.

7. The door assembly of claim 1 wherein the first sensor body includes a sensing circuit, the circuit having a mechanically deflectable first element, the deflectable first element being positioned such that an impact to the impact portion of the first sensor body in excess of a predetermined force will deflect the deflectable first element sufficiently to change the electrical state of the sensing circuit and generate a signal indicative of said change, and the second sensor body includes an actuator comprising a fluid-filled tube pneumatically coupled to a fluid pressure sensor, the pressure sensor being responsive to changes in the pressure of the fluid and generating a signal indicative of said changes in pressure.

8. The door assembly of claim 7 wherein deflection of the deflectable first element results in a change in voltage in the circuit, such change in voltage generating a signal indicative of said change.

9. The door assembly of claim 7 wherein deflection of the deflectable first element results in a change in inductance of the circuit, such change in inductance generating a signal indicative of said change.

10. The door assembly of claim 7 wherein deflection of the deflectable first element results in a change in impedance of the circuit, such change in impedance generating a signal indicative of said change.

11. The door assembly of claim 7 wherein the deflectable first element is a conductive polymer that structurally defines at least a portion of the impact portion of the sensor body, the polymer changing its electrical properties when deflected by the impact.

12. The door assembly of claim 7 wherein the sensing circuit includes a deflectable second element disposed adjacent the deflectable first element, wherein one of the deflectable first and second elements is coupled to a power source, the deflectable first and second elements being oriented such that when the impact portion of the sensor body receives an impact in excess of at least a predetermined force, one of the deflectable first and second elements is deflected toward the other of the deflectable first and second elements in such a manner as to change the electrical state of the circuit, such change in electrical state generating a signal indicative of said change.

13. The door assembly of claim 12 wherein the sensing circuit is normally an open circuit and deflection of the deflectable first and second elements one toward the other results in closing the circuit, thereby changing the electrical state of the circuit.

14. The door assembly of claim 1 wherein the first and second sensor bodies are mechanically coupled such that at least some force from an impact applied to one of the first and second sensor bodies is transferred and sufficiently to actuate to the other of the first and second sensor bodies.

* * * * *